US012590404B2

(12) United States Patent
Kim et al.

(10) Patent No.: US 12,590,404 B2
(45) Date of Patent: Mar. 31, 2026

(54) DRYER AND OPERATING METHOD THEREFOR

(71) Applicant: LG ELECTRONICS INC., Seoul (KR)

(72) Inventors: Yang Gyu Kim, Seoul (KR); Chan Ho Chun, Seoul (KR)

(73) Assignee: LG Electronics Inc., Seoul (KR)

( * ) Notice: Subject to any disclaimer, the term of this patent is extended or adjusted under 35 U.S.C. 154(b) by 916 days.

(21) Appl. No.: 17/788,630

(22) PCT Filed: Dec. 17, 2020

(86) PCT No.: PCT/KR2020/018605
§ 371 (c)(1),
(2) Date: Jun. 23, 2022

(87) PCT Pub. No.: WO2021/132989
PCT Pub. Date: Jul. 1, 2021

(65) Prior Publication Data

US 2023/0026828 A1 Jan. 26, 2023

(30) Foreign Application Priority Data

Dec. 24, 2019 (KR) ..... 10-2019-0173832

(51) Int. Cl.
*D06F 58/26* (2006.01)
*D06F 58/04* (2006.01)
*D06F 58/24* (2006.01)

(52) U.S. Cl.
CPC ..... *D06F 58/26* (2013.01); *D06F 58/04* (2013.01); *D06F 58/24* (2013.01)

(58) Field of Classification Search
CPC ..... D06F 58/04; D06F 58/24; D06F 58/26
(Continued)

(56) References Cited

U.S. PATENT DOCUMENTS 5,095,943 A * 3/1992 Ashi ..... G05D 23/123 251/317
2008/0235977 A1* 10/2008 Kuwabara ..... D06F 58/206 134/105

(Continued)

FOREIGN PATENT DOCUMENTS

CN 202390689 U 8/2012
GB 2083190 A 3/1982

(Continued)

OTHER PUBLICATIONS

Extended European Search Report in European Appln. No. 20905352.9, mailed on Dec. 6, 2012, 8 pages.

(Continued)

*Primary Examiner* — Connor J Tremarche
(74) *Attorney, Agent, or Firm* — Fish & Richardson P.C.

(57) ABSTRACT

A dryer and an operating method therefor are useful in a 5G environment provided for the Internet of Things. The dryer includes a heating device, a tumbler connected to the exit of the heating device, a fan connected to the exit of the tumbler, a heat exchanger disposed in a flow line of a working fluid connected to the exit of the fan, a compressor having an entrance connected to a flow line connected to the exit of the fan and an exit connected to the entrance of the heat exchanger, and a regeneration device having an entrance connected to the exit of the heat exchanger.

17 Claims, 5 Drawing Sheets

(58) Field of Classification Search
USPC ..... 34/261
See application file for complete search history.

(56) References Cited

U.S. PATENT DOCUMENTS

| | | | | |
|---|---|---|---|---|
| 2009/0056387 | A1* | 3/2009 | Beck | F22B 1/28 122/235.17 |
| 2011/0047813 | A1* | 3/2011 | Kuhl | D06F 58/206 34/73 |
| 2017/0145624 | A1* | 5/2017 | Dulberg | D06F 58/20 |

FOREIGN PATENT DOCUMENTS

| | | | |
|---|---|---|---|
| JP | 2000304449 | | 11/2000 |
| JP | 2001263950 | | 9/2001 |
| JP | 2007-306960 | A | 11/2007 |
| KR | 10-2013-0097402 | A | 9/2013 |
| KR | 20150010584 | | 1/2015 |
| KR | 10-1750911 | B1 | 6/2017 |
| KR | 10-2018-0050815 | A | 5/2018 |
| KR | 20180130218 | | 12/2018 |
| KR | 20190000146 | | 1/2019 |
| WO | 2015/165313 | A1 | 11/2015 |

OTHER PUBLICATIONS

Office Action in Chinese Appln. No. 202080090294.5, mailed on Mar. 28, 2025, 17 pages (with English translation).

* cited by examiner

DRYER AND OPERATING METHOD THEREFOR

CROSS-REFERENCE TO RELATED APPLICATIONS

This application is a National Stage application under 35 U.S.C. § 371 of International Application No. PCT/KR2020/018605, filed on Dec. 17, 2020, which claims the benefit of Korean Application No. 10-2019-0173832, filed on Dec. 24, 2019. The disclosures of the prior application are incorporated by reference in their entirety.

TECHNICAL FIELD

The present disclosure relates to a dryer and an operating method therefor, and more particularly to a dryer having a structure exhibiting improved heat transfer efficiency and performance and to an operating method therefor.

BACKGROUND ART

The content described in this section simply provides background information related to embodiments, and does not constitute the related art.

A dryer is used to dry an object to be dried, such as laundry. A dryer may be categorized into a gas type, an electric-heating type, and a heat-pump type depending on the method of obtaining heat for heating an object to be dried.

The gas type is a type that heats an object to be dried using heat generated by burning combustible gas. The gas-type dryer has disadvantages in that the overall size thereof is large and the structure thereof is complicated in order to receive gas supplied from outside.

The electric-heating type is a type that heats an object to be dried using heat obtained from an electric heater. The electric-heating-type dryer has advantages in that the size thereof is small and the structure thereof is simple.

However, because the electric-heating-type dryer uses electricity, which is an expensive energy source, the same is disadvantageous from the aspect of costs and energy efficiency.

The heat-pump type is a type that heats an object to be dried using heat obtained by transferring heat from a low-temperature thermal reservoir to a high-temperature thermal reservoir using a compressor.

The heat-pump-type dryer may obtain heat using a compressor, and may use electricity to operate the compressor.

However, unlike the electric-heating type, which generates heat by converting electricity into heat, the heat-pump type obtains heat by collecting heat from a low-temperature thermal reservoir and transferring the same to a high-temperature thermal reservoir, and is thus advantageous in that less power is consumed than in the case of the electric-heating type.

The demand for an electric-heating-type dryer having an advantage of low power consumption is continually increasing, and accordingly, research and development related thereto is being actively carried out.

DISCLOSURE OF INVENTION

Technical Problem

An object of the present disclosure is to provide a dryer having a structure exhibiting improved efficiency and performance and an operating method therefor.

An object of the present disclosure is to provide a dryer having a structure capable of preventing outside air at room temperature from being introduced into a circulation line through gaps between constituent elements of the circulation line and an operating method therefor.

An object of the present disclosure is to provide a dryer having a structure equipped with a regeneration device including a gas-liquid separator and an operating method therefor.

An object of the present disclosure is to provide a dryer having a structure equipped with a regeneration device including a preheating device and an operating method therefor.

Solution to Problem

In order to accomplish the above objects, a dryer according to an embodiment of the present disclosure may include a heating device, a tumbler connected to the exit of the heating device, a fan connected to the exit of the tumbler, a heat exchanger disposed in a flow line of a working fluid connected to the exit of the fan, a compressor having an entrance connected to a flow line connected to the exit of the fan and an exit connected to the entrance of the heat exchanger, and a regeneration device having an entrance connected to the exit of the heat exchanger.

The regeneration device may be connected to a circulation line of the working fluid interconnecting the heating device, the tumbler, the fan, and the heat exchanger.

The dryer according to the embodiment of the present disclosure may further include an accommodation part configured to accommodate the heat exchanger therein. The accommodation part may be connected to a flow line connected to the exit of the fan, a flow line connected to the entrance of the heating device, and a flow line connected to the entrance of the compressor.

The regeneration device may include a gas-liquid separator, and the gas-liquid separator may have a gas exit connected to the circulation line.

The gas exit of the gas-liquid separator may be connected to a flow line of the working fluid interconnecting the heating device and the tumbler.

The gas exit of the gas-liquid separator may be connected to a flow line of the working fluid interconnecting the tumbler and the fan.

The gas exit of the gas-liquid separator may be connected to a flow line of the working fluid connected to the exit of the fan.

The gas exit of the gas-liquid separator may be connected to a flow line of the working fluid connected to the entrance of the heating device.

The regeneration device may further include a steam trap connected to a condensed water exit of the gas-liquid separator.

The regeneration device may further include a decompression device provided in at least one of a flow line interconnecting the exit of the heat exchanger and the entrance of the gas-liquid separator or a flow line interconnecting the gas exit of the gas-liquid separator and the circulation line.

The regeneration device may further include bypass lines and bypass valves respectively disposed in the bypass lines. One of the bypass lines may have two ends connected to respective ends of the decompression device, and the remaining one of the bypass lines may have two ends connected to respective ends of the steam trap.

The regeneration device may include a preheating device, which is disposed in a flow line connected to the exit of the heat exchanger, and an outside air inflow line, which has an entrance receiving outside air introduced thereinto and an exit connected to the circulation line and is disposed so as to penetrate the preheating device.

The regeneration device may further include a control valve disposed adjacent to the entrance of the outside air inflow line.

The outside air inflow line may be connected to at least one of a flow line of the working fluid interconnecting the heating device and the tumbler, a flow line of the working fluid interconnecting the tumbler and the fan, a flow line of the working fluid connected to the exit of the fan, or a flow line of the working fluid connected to the entrance of the heating device.

A dryer operating method according to an embodiment of the present disclosure may include operating the fan, operating the compressor, operating the heating device, and stopping operation of the heating device when a set time period elapses.

The regeneration device may include a gas-liquid separator having a gas exit connected to the circulation line, a steam trap connected to a condensed water exit of the gas-liquid separator, a decompression device provided in at least one of a flow line interconnecting the exit of the heat exchanger and the entrance of the gas-liquid separator, a flow line interconnecting the gas exit of the gas-liquid separator and the circulation line, or a flow line having the steam trap disposed therein, bypass lines, and bypass valves respectively disposed in the bypass lines. One of the bypass lines may have two ends connected to respective ends of the decompression device, and the remaining one of the bypass lines may have two ends connected to respective ends of the steam trap.

The regeneration device may include a preheating device, which is disposed in a flow line connected to the exit of the heat exchanger, an outside air inflow line, which has an entrance receiving outside air introduced thereinto and an exit connected to the circulation line and is disposed so as to penetrate the preheating device, and a control valve, which is disposed adjacent to the entrance of the outside air inflow line.

Advantageous Effects of Invention

According to embodiments of the present disclosure, a working fluid flowing through a non-circulation line may be introduced into a circulation line through a regeneration line, or heated outside air may be introduced into the circulation line through the regeneration line, thereby making it possible to effectively prevent introduction of outside air into the circulation line through gaps between constituent elements of the circulation line.

According to embodiments of the present disclosure, heated working fluid in the non-circulation line or heated outside air may be introduced into the circulation line, thereby preventing negative pressure from being generated in the circulation line when a compressor operates. Accordingly, it is possible to effectively prevent outside air at room temperature from being introduced into the circulation line through gaps between constituent elements of the circulation line due to the generation of negative pressure.

According to embodiments of the present disclosure, outside air at room temperature may be prevented from being introduced into the circulation line, eliminating the need to heat this outside air. Accordingly, the efficiency of the dryer may be improved.

According to embodiments of the present disclosure, since only steam, which does not require latent heat of evaporation, is introduced into the circulation line using a gas-liquid separator, the pressure in the circulation line may be maintained at about atmospheric pressure. Accordingly, it is possible to effectively prevent outside air from being introduced into the circulation line through gaps between constituent elements of the circulation line.

According to embodiments of the present disclosure, since only steam is introduced into the circulation line, it is not necessary to additionally apply heat corresponding to the latent heat of evaporation of condensed water to the working fluid in the circulation line. Accordingly, the efficiency of the dryer may be improved.

According to embodiments of the present disclosure, a steam trap, which is connected to a condensed water exit of the gas-liquid separator, may be provided, whereby only condensed water may be discharged from the gas-liquid separator to a reservoir. Accordingly, the efficiency of the dryer may be improved.

According to embodiments of the present disclosure, since outside air heated by a preheating device is introduced into the circulation line, the heated outside air does not cause condensation of the working fluid in the circulation line. Accordingly, the efficiency of the dryer may be improved.

According to embodiments of the present disclosure, since outside air heated to a high temperature is introduced into the circulation line, the pressure in the circulation line may be maintained at about atmospheric pressure. Accordingly, it is possible to effectively prevent condensed water from being generated in the circulation line due to introduction of room-temperature outside air into the circulation line through gaps between constituent elements of the circulation line.

According to embodiments of the present disclosure, since outside air is heated by the preheating device, which uses the working fluid discharged from a heat exchanger as a high-temperature heat source, waste heat contained in the working fluid discharged from the heat exchanger may be effectively used. Accordingly, the efficiency of the dryer may be improved.

BRIEF DESCRIPTION OF DRAWINGS

The foregoing and other objects, features, and advantages of the invention, as well as the following detailed description of the embodiments, will be better understood when read in conjunction with the accompanying drawings. For the purpose of illustrating the invention, there is shown in the drawings an exemplary embodiment that is presently preferred, it being understood, however, that the invention is not intended to be limited to the details shown because various modifications and structural changes may be made therein without departing from the spirit of the invention and within the scope and range of equivalents of the claims. The use of the same reference numerals or symbols in different drawings indicates similar or identical items.

DESCRIPTION OF REFERENCE NUMERALS OF MAIN PARTS OF THE DRAWINGS

Figure 1:
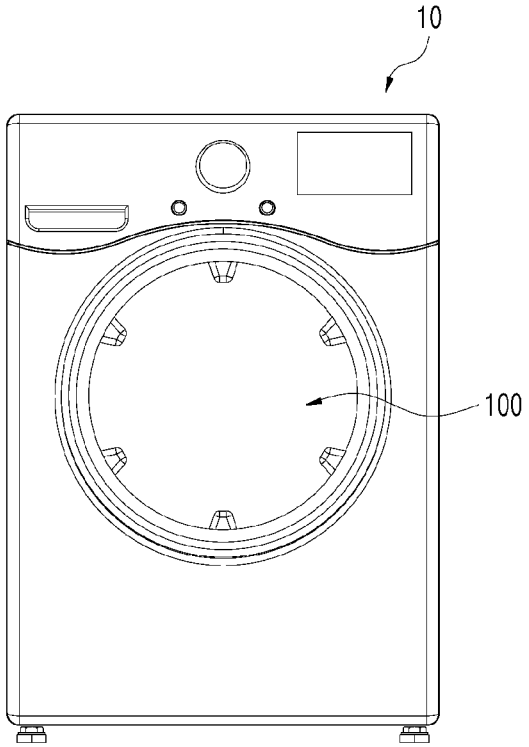
FIG. 1 is a view showing the external appearance of a dryer according to an embodiment of the present disclosure.

10: user interface
100: tumbler
200: fan
300: heat exchanger
400: compressor
500: heating device
600: accommodation part
700: regeneration device
710: gas-liquid separator
720: steam trap
730: decompression device
740: bypass line
750: bypass valve
760: preheating device
770: outside air inflow line
780: control valve
800: reservoir
900: controller

BEST MODE FOR CARRY OUT THE INVENTION

Hereinafter, exemplary embodiments of the present disclosure will be described in detail with reference to the accompanying drawings. In the following description of the present disclosure, a detailed description of known functions and configurations incorporated herein will be omitted to make the gist of the present disclosure clear.

FIG. 1 is a view showing the external appearance of a dryer according to an embodiment. The dryer according to the embodiment may be used, for example, to dry laundry that has not been dried after completion of washing. Of course, the dryer may also be used to dry wet clothes, regardless of whether washing is performed.

An object to be dried may be received in a tumbler 100 provided in the dryer. Referring to FIG. 1, the tumbler 100 may be formed, for example, in a cylindrical shape, and may be provided so as to rotate as needed.

The dryer may be provided with a user interface 10. The user interface 10 may be electrically connected to a controller 900 to be described later, and a user may control the operation of the dryer using the user interface 10.

For example, the user interface 10 may be provided with a display, a capacitive touch button, a physical button, a dial, a speaker through which the dryer utters a voice, a microphone through which the user inputs a voice command, and the like.

Therefore, the user may obtain information necessary for operation from the dryer in the form of text, a voice, or the like. In addition, the user may input a voice command, or may manually manipulate the button, the dial, or the like in order to operate the dryer.

The dryer may further include a transceiver, which is connected to the controller 900, and the controller 900 may communicate with a server, a terminal of the user, and other external devices through the transceiver.

The transceiver may include at least one of a mobile communication module or a wireless Internet module. In addition, the transceiver may further include a short-range communication module.

The mobile communication module transmits and receives wireless signals to and from at least one of a base station, an external terminal, or a server via a mobile communication network established according to technical standards or communication schemes for mobile communication (for example, global system for mobile communication (GSM), code division multi access (CDMA), code division multi access 2000 (CDMA2000), enhanced voice-data optimized or enhanced voice-data only (EV-DO), wide-band CDMA (WCDMA), high speed downlink packet access (HSDPA), high speed uplink packet access (HSUPA), long term evolution (LTE), long term evolution-advanced (LTE-A), $5^{th}$ generation (5G) mobile communication, and the like).

The wireless Internet module refers to a module for wireless Internet access. The wireless Internet module may be provided in the dryer. The wireless internet module is configured to transmit and receive wireless signals via a communication network using wireless Internet technology.

The dryer may transmit and receive data to and from a server and various terminals capable of performing communication via a 5G network. In particular, the dryer may perform data communication with the server and the terminals using at least one service among enhanced mobile broadband (eMBB), ultra-reliable and low latency communications (URLLC), and massive machine-type communications (mMTC) via a 5G network.

Enhanced mobile broadband (eMBB) is a mobile broadband service, and multimedia content, wireless data access, etc. are provided over eMBB. Further, improved mobile services, such as hotspots and broadband coverage for receiving mobile traffic, the amount of which is tremendously increasing, may be provided over eMBB. Through hotspots, high-volume traffic may be received in an area in which user mobility is low and user density is high. Through broadband coverage, a wide-range and stable wireless environment and user mobility may be ensured.

An ultra-reliable and low latency communications (URLLC) service defines much more stringent requirements than existing LTE in terms of reliability in data transmission/reception and transmission delay, and 5G services for automation of production processes at industrial sites, telemedicine, telesurgery, transportation, safety, etc. are representative examples thereof.

A massive machine-type communications (mMTC) service is a service that is not sensitive to transmission delay and is required for transmission of a relatively small amount of data. Terminals present in a much larger number than general mobile phones, such as sensors, may be connected to a wireless access network by mMTC at the same time. In this case, the communication module of the terminal needs to be inexpensive, and there is a need for improved power efficiency and power-saving technology enabling operation for years without replacement or recharging of a battery.

The dryer of the embodiment may employ a thermodynamic cycle in order to apply heat to the object to be dried received in the tumbler 100.

A working fluid used to implement the thermodynamic cycle of the dryer may be a mixture of air and gaseous water, i.e. steam. In this case, the ratio of air to steam in the working fluid may change while the working fluid circulates through the respective components of the dryer.

Figure 2:
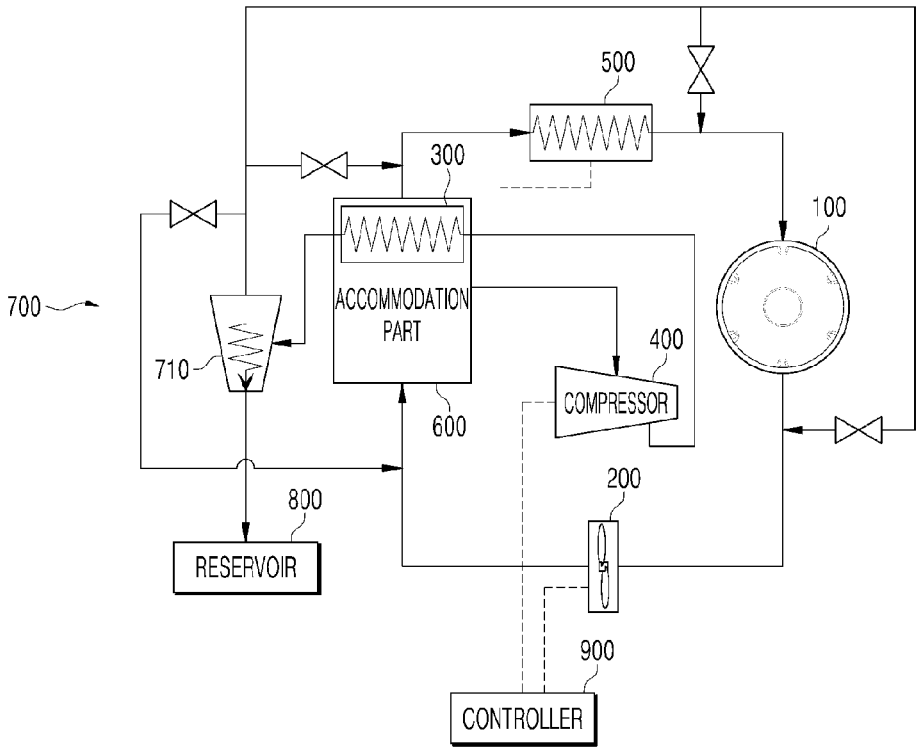
FIG. 2 is a diagram showing the structure of a dryer according to an embodiment of the present disclosure.

FIG. 2 is a diagram showing the structure of a dryer according to an embodiment.

The dryer may be provided with a flow line through which the working fluid flows. The flow line may interconnect respective components of the dryer, which will be described below. The flow line may be configured as, for example, a pipe, a hose, a duct, or a combination thereof.

The flow line of the working fluid in the dryer may include a circulation line, a non-circulation line, and a regeneration line.

The circulation line is a line interconnecting a heating device 500, a tumbler 100, a fan 200, and a heat exchanger 300, and the working fluid may circulate along the circulation line. The fan 200 may blow the working fluid so that the working fluid flows along the circulation line.

The non-circulation line may branch from the circulation line upstream of the heat exchanger 300 so as to be connected to a compressor 400, and may be connected to the compressor 400 and the heat exchanger 300. The working fluid flowing through the non-circulation line may be introduced into and compressed by the compressor 400, and may then pass through the heat exchanger 300.

A portion of the working fluid in the circulation line may be introduced into the non-circulation line, which branches from the circulation line. The working fluid introduced into the non-circulation line may be compressed by the compressor 400, and thus may be heated to a high temperature.

The heated working fluid discharged from the compressor 400 in the non-circulation line may be introduced into the heat exchanger 300, may exchange heat with the working fluid in the circulation line, which has a relatively low temperature, and may be discharged from the heat exchanger 300.

The regeneration line is a flow line of the working fluid that interconnects the exit of the heat exchanger 300 and the circulation line. A regeneration device 700 may be disposed in the regeneration line.

In the embodiment, the regeneration line may be understood as including a flow line interconnecting the exit of the heat exchanger 300 and the entrance of the regeneration device 700 and a flow line interconnecting the exit of the regeneration device 700 and the circulation line.

As described above, the working fluid in the circulation line is heated by the heat exchanger 300, and is introduced into the tumbler 100 to heat the object to be dried accommodated in the tumbler 100, thereby drying the object to be dried.

After the operation of the dryer commences, it is necessary to quickly heat the object to be dried at the initial stage of a drying operation in order to quickly and efficiently perform the drying operation.

This initial heating serves to heat the working fluid in the circulation line. In order to implement initial heating, a heating device 500 may be provided in the circulation line connected to the entrance of the tumbler 100.

During initial heating, the object to be dried in the tumbler 100 is continuously heated, and accordingly, the water contained in the object to be dried continues to evaporate, so the working fluid in the circulation line and the working fluid in the non-circulation line contain a sufficient amount of steam. Thereby, heat exchange may be smoothly performed in the heat exchanger 300, and at this time initial heating may be terminated.

For example, the time period required for initial heating may be set in consideration of the specifications of the dryer, and initial heating may be terminated when the set time period elapses.

In another embodiment, the humidity of the working fluid may be measured using a humidity sensor disposed at an appropriate position among the circulation line of the working fluid, the non-circulation line of the working fluid, and the respective components, and initial heating may be terminated when the humidity reaches a predetermined range.

The heating device 500 may heat the working fluid flowing through the circulation line. The heated working fluid may flow into the tumbler 100, and the object to be dried in the tumbler 100 may be heated by the working fluid. Accordingly, the water contained in the object to be dried may be evaporated and vaporized.

When the compressor 400 is operated to implement the drying operation, the working fluid in the circulation line may continuously escape therefrom through the non-circulation line. Therefore, the mass of the working fluid in the circulation line may continuously decrease, and the pressure in the circulation line may be at least temporarily maintained at negative pressure, which is lower than external pressure, i.e. atmospheric pressure.

When the pressure in the circulation line becomes negative, outside air may be introduced into the circulation line through gaps between pipes or ducts constituting the circulation line.

The outside air introduced into the circulation line may be used as the working fluid. However, because the outside air is at room temperature, the temperature of the outside air may be lower than that of the heated working fluid flowing through the circulation line.

The working fluid in the circulation line, which has a high temperature, may be cooled by the outside air introduced into the circulation line, and thus the temperature of the working fluid may drop to a dew-point temperature or lower. Therefore, water contained in the working fluid may be condensed to liquid.

That is, condensation of water may occur in the circulation line due to the outside air. In order to heat and evaporate the water condensed in the circulation line, it may be required to input a large amount of heat, corresponding to the latent heat of evaporation.

For this reason, when a given amount of work, i.e. power, is applied to the compressor 400 and the heating device 500, the amount of steam in the circulation line may be reduced, and thus the efficiency of the dryer may decrease compared to the case in which condensation of water does not occur in the circulation line.

In order to increase the amount of steam to thus realize smooth drying operation, the amount of power consumed by the compressor 400 and the heating device 500 may be increased. However, this also deteriorates the efficiency of the dryer.

Further, heat is required to heat the room-temperature outside air that is introduced into the circulation line through gaps between constituent elements of the circulation line. This also deteriorates the efficiency of the dryer.

Therefore, it is necessary to prevent the introduction of room-temperature outside air into the circulation line. In the embodiment, the working fluid flowing through the non-circulation line may be introduced into the circulation line through the regeneration line, or heated outside air may be introduced into the circulation line through the regeneration line, thereby making it possible to effectively prevent the introduction of outside air into the circulation line through gaps between constituent elements of the circulation line.

That is, heated working fluid in the non-circulation line or heated outside air may be introduced into the circulation line, thereby preventing negative pressure from being generated in the circulation line when the compressor 400 operates. Accordingly, it is possible to effectively prevent outside air at room temperature from being introduced into the circulation line through gaps between constituent elements of the circulation line due to the generation of negative pressure.

In the embodiment, outside air at room temperature may be prevented from being introduced into the circulation line, eliminating the need to heat this outside air. Accordingly, the efficiency of the dryer may be improved.

Hereinafter, the structure of the dryer according to the embodiment will be described in detail with reference to FIG. 2 and the drawings below.

Referring to FIG. 2, the dryer according to the embodiment may include a heating device 500, a tumbler 100, a fan 200, a heat exchanger 300, and a compressor 400.

The tumbler 100 may be connected to the exit of the heating device 500. The structure and function of the tumbler 100 are as described above.

The heating device 500 may be disposed between the tumbler 100 and the heat exchanger 300 in the circulation line. The heating device 500 may be configured as, for example, an electric heater, but the disclosure is not limited thereto.

As described above, the heating device 500 may be used, for example, for initial heating of the working fluid flowing through the circulation line. Therefore, operation of the heating device 500 may be stopped when initial heating is completed. In addition, even after initial heating is completed, the heating device 500 may be operated again at any time in order to heat the working fluid in the circulation line.

The fan 200 may be disposed so as to be connected to the exit of the tumbler 100. The fan 200 and the tumbler 100 may be connected to each other via the circulation line of the working fluid. The fan 200 may blow the working fluid introduced from the tumbler 100 so that the working fluid circulates through the circulation line.

The heat exchanger 300 may be disposed in the flow line of the working fluid that is connected to the exit of the fan 200. That is, the heat exchanger 300 may be disposed in the circulation line of the working fluid that interconnects the fan 200 and the tumbler 100.

In addition, the heat exchanger 300 may be configured such that the non-circulation line of the working fluid that is connected to the exit of the compressor 400 passes therethrough.

Due to this structure, the working fluid in the circulation line, which has a relatively low temperature, and the working fluid in the non-circulation line, which is compressed by the compressor 400 and thus has a relatively high temperature, may exchange heat therebetween in the heat exchanger 300.

Meanwhile, during initial heating of the working fluid, the working fluid in the non-circulation line is further heated by the heating device 500, whereby heat exchange may occur more actively in the heat exchanger 300.

The working fluid in the circulation line, which is heated through the heat exchanger 300, may flow back into the tumbler 100, and may heat and dry the object to be dried in the tumbler 100.

The dryer according to the embodiment may further include an accommodation part 600, in which the heat exchanger 300 is accommodated. For example, the accommodation part 600 may be configured as a duct, and may constitute a part of the circulation line.

The accommodation part 600 may be designed to have a large cross-sectional area in order to increase the contact area between the working fluid in the circulation line and the surface of the heat exchanger 300, thereby increasing the efficiency of heat exchange between the working fluid in the circulation line and the working fluid in the non-circulation line.

However, it is appropriate to set the cross-sectional area of the accommodation part 600 in consideration of the overall size of the dryer, the size of the space occupied by the accommodation part 600, and the size of the heat exchanger 300.

As shown in FIG. 2, the accommodation part 600 may be connected to the flow line connected to the exit of the fan 200, to the flow line connected to the entrance of the tumbler 100, and to the flow line connected to the entrance of the compressor 400.

That is, the accommodation part 600 may be connected both to the circulation line and to the non-circulation line of the working fluid. The heat exchanger 300 may be configured as, for example, an open type, in which the working fluid in the circulation line and the working fluid in the non-circulation line mix with each other, or a closed type, in which the two working fluids flow separately from each other. The heat exchanger 300 according to the embodiment may be configured as, for example, a closed type.

When the closed-type heat exchanger 300 is used, the non-circulation line of the working fluid may be directly connected to the heat exchanger 300 disposed in the accommodation part 600, and the working fluid in the non-circulation line may be separated from the working fluid in the circulation line inside the accommodation part 600, rather than being mixed therewith.

The compressor 400 may be connected at the entrance thereof to the flow line connected to the exit of the fan 200, and may be connected at the exit thereof to the entrance of the heat exchanger 300.

The compressor 400 may be connected to the non-circulation line of the working fluid, and a portion of the working fluid flowing through the circulation line may be introduced into the compressor 400. The working fluid introduced into the non-circulation line may be compressed by the compressor 400 to a high temperature, and may then be introduced into the heat exchanger 300.

The compressor 400 may be configured as any of various types, such as, for example, a reciprocating type, a rotary type, a screw type, a scroll type, a centrifugal type, and an axial type. It is appropriate to select the type of compressor 400 in consideration of the size and the specific characteristics thereof.

The dryer according to the embodiment may further include a reservoir 800 and a controller 900.

The reservoir 800 may be connected to the exit of the regeneration device 700. For example, the regeneration device 700 may include a gas-liquid separator 710, a steam trap 720, and a preheating device 760, and the reservoir 800 may be connected to the exit of the gas-liquid separator 710, to the exit of the steam trap 720, or to the exit of the preheating device 760, and may store water that has passed through the regeneration device 700.

While the working fluid passes through the heat exchanger 300 or the regeneration device 700 before entering the reservoir 800, at least a portion of the steam contained in the working fluid may be condensed, so liquid water, i.e. condensed water, may be generated. Thus, the reservoir 800 may store the condensed water introduced thereinto.

The controller 900 may be electrically connected to the heating device 500, the fan 200, the compressor 400, and a control valve 780. In addition, the controller 900 may be electrically connected to other components of the dryer that need to be electrically controlled.

The controller 900 may control the respective components of the dryer, and thus may control the overall operation of the dryer according to the embodiment. For example, the controller 900 may apply power to the heating device 500, may control the operation of the fan 200, may control the operation of the compressor 400, or may control opening and closing of the control valve 780.

As described above, the controller 900 may be connected to the user interface 10 and the transceiver to receive a user's command, to transmit a necessary notification to the user, or to communicate with an external device such as a server.

The regeneration device 700 may be connected at the entrance thereof to the exit of the heat exchanger 300. The regeneration device 700 may be connected to the circulation line of the working fluid, which interconnects the heating device 500, the tumbler 100, the fan 200, and the heat exchanger 300.

Figure 3:
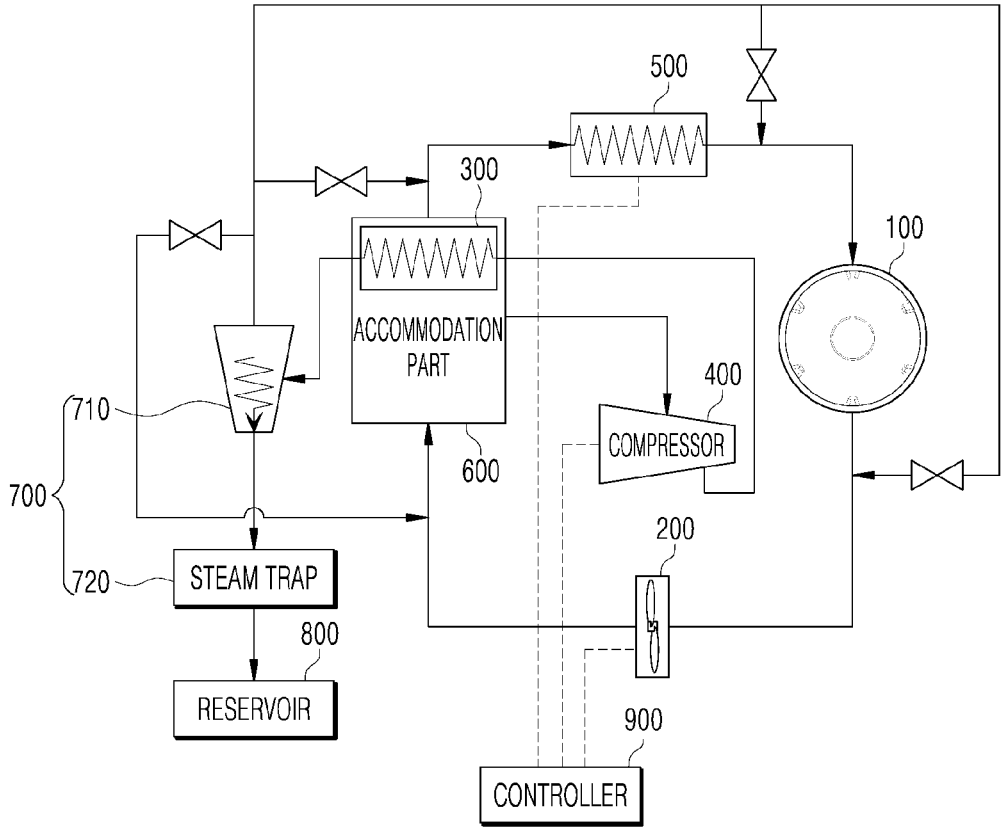
FIG. 3 is a diagram showing the structure of a dryer according to another embodiment of the present disclosure.
Figure 4:
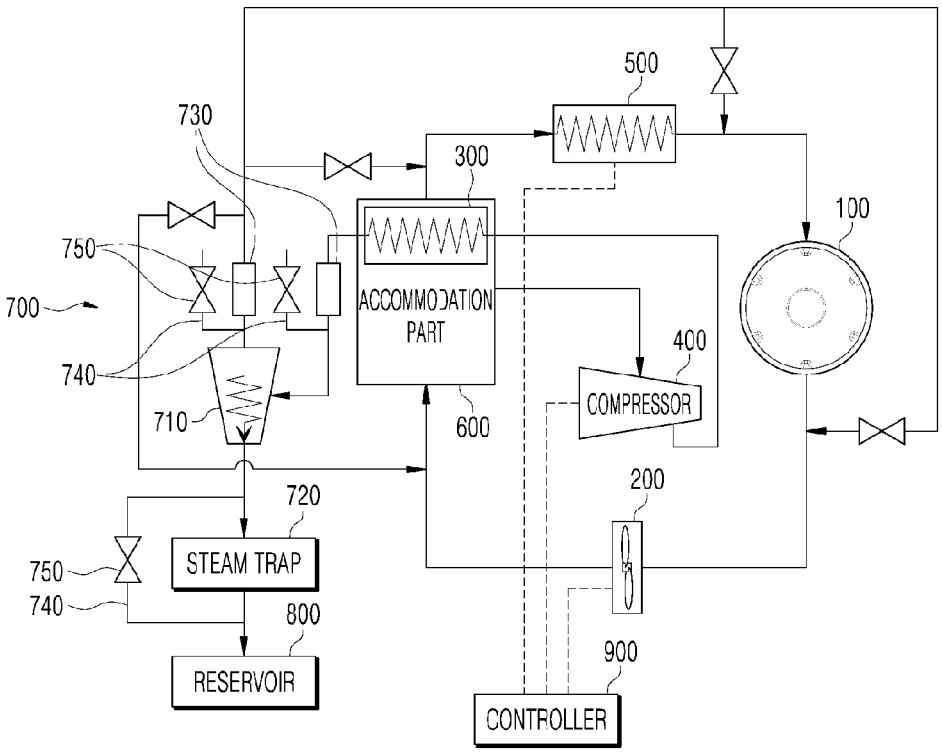
FIG. 4 is a diagram showing the structure of a dryer according to still another embodiment of the present disclosure.
Figure 5:
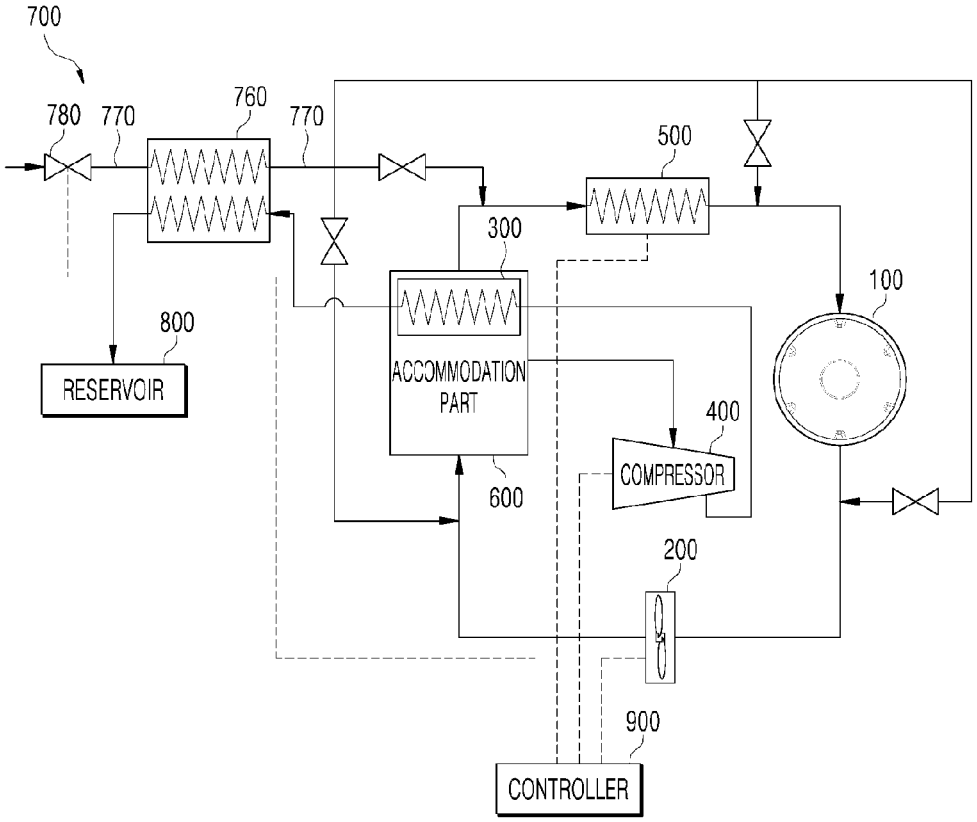
FIG. 5 is a diagram showing the structure of a dryer according to still another embodiment of the present disclosure.

In one embodiment, as shown in FIGS. 2 to 4, the regeneration device 700 may include a gas-liquid separator 710. In another embodiment, as shown in FIG. 5, the regeneration device 700 may include a preheating device 760.

Hereinafter, the structure of the regeneration device 700 including the gas-liquid separator 710 will be first described with reference to FIGS. 2 to 4.

Referring to FIG. 2, the regeneration device 700 may include a gas-liquid separator 710. The gas-liquid separator 710 may be connected at the entrance thereof to the heat exchanger 300. In addition, the gas exit of the gas-liquid separator 710 may be connected to the circulation line. In addition, the condensate water exit of the gas-liquid separator 710 may be connected to the reservoir 800.

In the gas-liquid separator 710, the working fluid introduced thereinto may be separated into condensed water, which is liquid, and steam, which is gas. The condensed water separated in the gas-liquid separator 710 may be introduced into the reservoir 800, and the steam separated in the gas-liquid separator 710 may be introduced into the circulation line.

The working fluid introduced into the circulation line from the gas-liquid separator 710 may circulate through the circulation line, and may be used to dry the object to be dried in the tumbler 100. Therefore, when the condensed water is introduced into the circulation line, it is required to input a large amount of heat, corresponding to the latent heat of evaporation, in order to evaporate the condensed water. This is not advantageous compared to the case in which outside air at room temperature is introduced into the circulation line and is heated.

Therefore, according to the embodiment, only steam, which does not require latent heat of evaporation, may be introduced into the circulation line using the gas-liquid separator 710, and accordingly, the pressure in the circulation line may be maintained at about atmospheric pressure. As a result, it is possible to effectively prevent outside air from being introduced into the circulation line through gaps between constituent elements of the circulation line.

In addition, since only steam is introduced into the circulation line, it is not necessary to additionally apply heat corresponding to the latent heat of evaporation of the condensed water to the working fluid in the circulation line. Accordingly, the efficiency of the dryer may be improved.

The gas exit of the gas-liquid separator 710 may be connected to the flow line of the working fluid that interconnects the heating device 500 and the tumbler 100. Alternatively, the gas exit of the gas-liquid separator 710 may be connected to the flow line of the working fluid that interconnects the tumbler 100 and the fan 200.

Alternatively, the gas exit of the gas-liquid separator 710 may be connected to the flow line of the working fluid that is connected to the exit of the fan 200. Alternatively, the gas exit of the gas-liquid separator 710 may be connected to the flow line of the working fluid that is connected to the entrance of the heating device 500.

That is, as shown in FIG. 2, the circulation line may be divided into four segment lines by the heating device 500, the tumbler 100, the fan 200, and the heat exchanger 300, and the gas exit of the gas-liquid separator 710 may be connected to at least one of the four segment lines.

In one embodiment, as shown in FIG. 2, valves for controlling flow of the working fluid may be mounted in respective regeneration lines, each of which is connected to a corresponding one of the four segment lines of the circulation line. The respective valves may be opened or closed so that the working fluid discharged from the gas-liquid separator 710 is introduced into all or some of the four segment lines of the circulation line.

In another embodiment, the gas exit of the gas-liquid separator 710 may be connected to only some of the four segment lines of the circulation line.

Due to this structure, the steam discharged from the gas-liquid separator 710 may be introduced into all or some of the four segment lines of the circulation line, and accordingly, the pressure in the circulation line may be maintained at about atmospheric pressure. As a result, it is possible to effectively prevent outside air from being introduced into the circulation line through gaps between constituent elements of the circulation line.

FIG. 3 is a diagram showing the structure of a dryer according to another embodiment. As shown in FIG. 3, the regeneration device 700 including the gas-liquid separator 710 may further include a steam trap 720, which is connected to the condensed water exit of the gas-liquid separator 710.

The steam trap 720 may be disposed in the flow line interconnecting the condensed water exit of the gas-liquid separator 710 and the reservoir 800.

Steam and condensed water may not be completely separated from each other in the gas-liquid separator 710, and a portion of the condensed water discharged from the gas-liquid separator 710 may be vaporized due to a temporary pressure drop in the flow line, whereby additional steam may be generated.

For this reason, the working fluid discharged from the gas-liquid separator 710 may include steam as well as condensed water. Therefore, the steam trap 720 may be disposed in the flow line connected to the condensed water exit of the gas-liquid separator 710 in order to prevent steam from being discharged to the reservoir 800.

Condensed water contained in the working fluid introduced into the steam trap 720 passes through the steam trap 720, and is introduced into the reservoir 800, and steam contained therein does not pass through the steam trap 720. The steam that does not pass through the steam trap 720 may be introduced into the circulation line through the gas exit of the gas-liquid separator 710.

According to the embodiment, the steam trap 720, which is connected to the condensed water exit of the gas-liquid separator 710, is provided, whereby only condensed water is discharged from the gas-liquid separator 710 to the reservoir 800. Accordingly, the efficiency of the dryer may be improved.

FIG. 4 is a diagram showing the structure of a dryer according to still another embodiment. Referring to FIG. 4, the regeneration device 700 including the gas-liquid separator 710 may further include a decompression device 730.

For example, the regeneration device 700 may further include a decompression device 730, which is provided in at least one of a flow line interconnecting the exit of the heat exchanger 300 and the entrance of the gas-liquid separator 710 or a flow line interconnecting the gas exit of the gas-liquid separator 710 and the circulation line.

Since the working fluid in the non-circulation line, which passes through the heat exchanger 300 and flows into the gas-liquid separator 710, is compressed by the compressor 400, the same is in a high-temperature and high-pressure state compared to the working fluid in the circulation line. The pressure of the working fluid in the circulation line is equal to or similar to atmospheric pressure.

Therefore, decompression and temperature drop are required so that the steam flowing into the circulation line through the regeneration line has pressure and temperature equal to or similar to those of the working fluid in the circulation line.

According to the embodiment, the decompression device 730 may be mounted in at least one of a segment regeneration line disposed upstream of the gas-liquid separator 710 or a segment regeneration line disposed downstream of the gas-liquid separator 710, whereby the temperature and pressure of the steam discharged from the gas exit of the gas-liquid separator 710 and introduced into the circulation line may be lowered so as to be suitable for the circulation line.

The decompression device 730 may be configured as, for example, an expansion valve, a throttling device, a capillary device, or the like. However, the disclosure is not limited thereto, and the decompression device 730 may have any of various structures, so long as the same is capable of lowering the pressure and temperature of the working fluid.

The regeneration device 700 may further include a bypass line 740 and a bypass valve 750. The bypass line 740 may be provided in plural such that the two ends of one bypass line 740 are connected to respective ends of the decompression device 730 and the two ends of another bypass line 740 are connected to respective ends of the steam trap 720. The bypass valve 750 may be disposed in each bypass line 740.

In an emergency state in which the decompression device 730 or the steam trap 720 malfunctions or operates abnormally, it is necessary to move the working fluid so as to bypass the same.

In such an emergency state, the bypass valve 750 may be opened so that the working fluid bypasses the decompression device 730 or the steam trap 720 through the bypass line 740.

FIG. 5 is a diagram showing the structure of a dryer according to still another embodiment. Compared to the dryers shown in FIGS. 2 to 4, the dryer shown in FIG. 5 may include a regeneration device 700 including a preheating device 760 instead of the gas-liquid separator 710.

In the embodiment shown in FIG. 5, the names of flow lines will be defined as follows for clarity of description in comparison with those in the embodiments shown in FIGS. 2 to 4.

A circulation line is the same as the circulation line of each of the embodiments shown in FIGS. 2 to 4. A non-circulation line is a flow line branching from the circulation line and interconnecting the compressor 400, the heat exchanger 300, the preheating device 760, and the reservoir 800. An outside air inflow line 770 is a flow line that interconnects the control valve 780 and the preheating device 760, receives outside air introduced thereinto, and is connected to the circulation line.

Referring to FIG. 5, the dryer may include the preheating device 760 and the outside air inflow line 770. The preheating device 760 may be disposed in a flow line connected to the exit of the heat exchanger 300. The outside air inflow line 770 may receive outside air introduced thereinto through the entrance thereof, may be connected at the exit thereof to the circulation line, and may be disposed so as to penetrate the preheating device 760.

The working fluid discharged from the heat exchanger 300 may exchange heat with outside air in the preheating device 760, and may be discharged to the reservoir 800.

The outside air inflow line 770 may be disposed so as to penetrate the heat exchanger 300, and may be connected to the circulation line. Outside air may be introduced into the outside air inflow line 770, may be heated while passing through the heat exchanger 300, and may be introduced into the circulation line.

According to the embodiment, since outside air heated by the preheating device 760 is introduced into the circulation line, the heated outside air does not cause condensation of the working fluid in the circulation line. Accordingly, the efficiency of the dryer may be improved.

In addition, since outside air heated to a high temperature is introduced into the circulation line, the pressure in the circulation line may be maintained at about atmospheric pressure. Accordingly, it is possible to effectively prevent condensed water from being generated in the circulation line due to introduction of room-temperature outside air into the circulation line through gaps between constituent elements of the circulation line.

The regeneration device 700 may further include a control valve 780, which is disposed adjacent to the entrance of the outside air inflow line 770. The control valve 780 may be electrically connected to the controller 900, and the controller 900 may control opening and closing of the control valve 780.

The controller 900 may open the control valve 780 so that outside air is introduced into the outside air inflow line 770, is heated by the preheating device 760, and is then introduced into the circulation line. In addition, the controller 900 may close the control valve 780 to block the introduction of outside air into the outside air inflow line 770, thereby stopping the operation of the regeneration device 700.

The preheating device 760 may be configured as, for example, an open type, in which the working fluid in the non-circulation line and the outside air in the outside air inflow line 770 mix with each other, or a closed type, in which the working fluid and the outside air flow separately from each other. The preheating device 760 according to the embodiment may be configured as, for example, a closed type.

The outside air inflow line 770 may be connected to at least one of the flow line of the working fluid that interconnects the heating device 500 and the tumbler 100, the flow line of the working fluid that interconnects the tumbler 100 and the fan 200, the flow line of the working fluid that is connected to the exit of the fan 200, or the flow line of the working fluid that is connected to the entrance of the heating device 500.

That is, as shown in FIG. 5, the circulation line may be divided into four segment lines by the heating device 500, the tumbler 100, the fan 200, and the heat exchanger 300, and the outside air inflow line 770 may be connected to at least one of the four segment lines.

In one embodiment, as shown in FIG. 5, valves for controlling flow of the working fluid may be mounted in respective outside air inflow lines, each of which is connected to a corresponding one of the four segment lines of the circulation line. The respective valves may be opened or closed so that the outside air heated by the preheating device 760 is introduced into all or some of the four segment lines of the circulation line.

In another embodiment, the outside air inflow line 770 may be connected to only some of the four segment lines of the circulation line.

Due to this structure, the heated outside air may be introduced into all or some of the four segment lines of the circulation line, and accordingly, the pressure in the circulation line may be maintained at about atmospheric pressure. As a result, it is possible to effectively prevent outside air at room temperature from being introduced into the circulation line through gaps between constituent elements of the circulation line.

According to the embodiment, since outside air is heated by the preheating device 760, which uses the working fluid discharged from the heat exchanger 300 as a high-temperature heat source, waste heat contained in the working fluid discharged from the heat exchanger 300 may be effectively used. Accordingly, the efficiency of the dryer may be improved.

Meanwhile, since the steam trap 720 (refer to FIGS. 3 and 4) described above is disposed in the flow line interconnecting the preheating device and the reservoir 800, the efficiency of the dryer may be improved.

Figure 6:
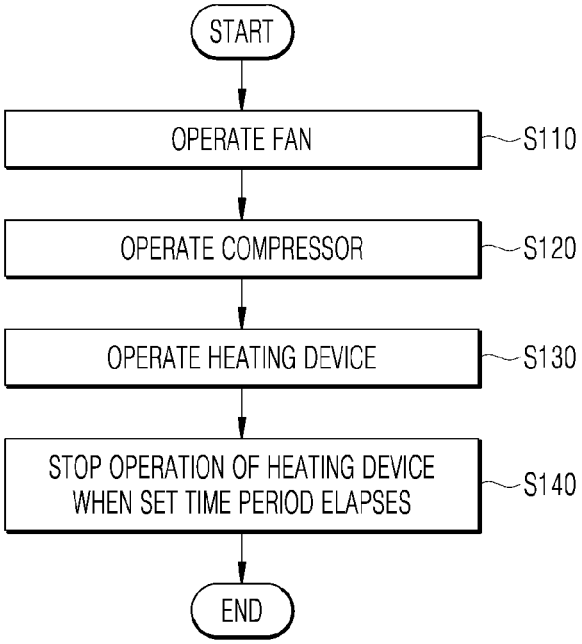
FIG. 6 is a flowchart showing a dryer operating method according to an embodiment of the present disclosure.

FIG. 6 is a flowchart showing a dryer operating method according to an embodiment. The dryer operating method of the embodiment may be used for the dryer described above. The operation of the dryer may be performed, for example, by the above-described controller 900.

The dryer operating method of the embodiment may relate to initial heating of the dryer. Hereinafter, commencement and completion of initial heating of the dryer will be described in detail.

When an object to be dried is received in the tumbler 100, the controller 900 may operate the fan 200 (S110).

As the fan 200 operates, the working fluid may flow through the circulation line of the dryer. In step S110, the working fluid in the circulation line is in a non-heated state.

The controller 900 may operate the compressor 400 (S120). As the compressor 400 operates, the working fluid may be introduced into the compressor 400 through the non-circulation line branching from the circulation line, and may be compressed.

For example, the non-circulation line may branch from the flow line, and a portion of the working fluid in the flow line may be introduced into the compressor 400. The working fluid in the non-circulation line may be compressed to a high temperature by the compressor 400, and may be introduced into the heat exchanger 300.

As the compressor 400 operates, heat exchange may occur in the regeneration device 700. However, in the case of the regeneration device 700 including the preheating device 760, the controller 900 may open the control valve 780 so that outside air is introduced into the preheating device 760 and heat exchange occurs in the preheating device 760.

It is necessary to quickly heat the object to be dried at the initial stage of a drying operation in order to quickly and efficiently perform the drying operation. When the compressor 400 operates, the working fluid in the non-circulation line may be heated, and the working fluid in the circulation line may be heated through heat exchange in the heat exchanger 300.

According to the embodiment, the working fluid in the circulation line may be further heated using the heating device 500 in order to more rapidly heat the object to be dried to thus more quickly evaporate the water contained in the object to be dried.

The controller 900 may operate the heating device 500 (S130). For example, when the heating device 500 is configured as an electric heater, the controller 900 may apply power to the heating device 500 to operate the heating device 500. The working fluid in the circulation line may be quickly heated by the heating device 500.

The heated working fluid in the circulation line may be introduced into the tumbler 100, and may heat the object to be dried received in the tumbler 100, thereby evaporating the water contained in the object to be dried.

When a set time period elapses, the controller 900 may stop the operation of the heating device 500 (S140). When the operation of the heating device 500 is stopped, initial heating of the working fluid in the circulation line may be terminated.

As described above, during initial heating, the object to be dried in the tumbler 100 is continuously heated, and accordingly, the water contained in the object to be dried continues to evaporate, so the working fluid in the circulation line and the working fluid in the non-circulation line contain a sufficient amount of steam. Thereby, heat exchange may be smoothly performed in the heat exchanger 300, and at this time initial heating may be terminated.

For example, the time period required for initial heating may be set in consideration of the specifications of the dryer, and initial heating may be terminated when the set time period elapses.

In another embodiment, the humidity of the working fluid may be measured using a humidity sensor, which is disposed at an appropriate position among the circulation line of the working fluid, the non-circulation line of the working fluid, the regeneration line, the outside air inflow line 770, and the respective components, and initial heating may be terminated when the humidity reaches a predetermined range.

Meanwhile, even after initial heating by the heating device 500 described above is terminated, the regeneration device 700 may continue to operate, thereby effectively preventing outside air at room temperature from being introduced into the circulation line.

The present disclosure described as above is not limited by the aspects described herein and accompanying drawings. It should be apparent to those skilled in the art that various substitutions, changes, and modifications that are not exemplified herein but are still within the spirit and scope of the present disclosure may be made. Therefore, the scope of the present disclosure is defined not by the detailed description, but by the claims and their equivalents, and all variations within the scope of the claims and their equivalents are to be construed as being included in the present disclosure.

MODE(S) FOR CARRYING OUT THE INVENTION

Many modifications to the above embodiments may be made without altering the nature of the invention. The dimensions and shapes of the components and the construction materials may be modified for particular circumstances. While various embodiments have been described above, it should be understood that they have been presented by way of example only, and not as limitations.

INDUSTRIAL APPLICABILITY

According to the dryer and the operating method therefor according to the present disclosure, the working fluid flowing through the non-circulation line may be introduced into the circulation line through the regeneration line, or heated outside air may be introduced into the circulation line through the regeneration line, thereby making it possible to effectively prevent introduction of outside air into the circulation line through gaps between constituent elements of the circulation line. As such, since the present disclosure overcomes the limits of existing technology, the present disclosure is not only useful in the field discussed herein, but also increases the marketability and business potential of apparatuses to which the present disclosure is applicable, and can be practically and explicitly implemented. Accordingly, the present disclosure has industrial applicability.

The invention claimed is:

1. A dryer comprising:

a heating device;

a tumbler connected to an exit of the heating device and configured to receive one or more objects to be dried;

a fan connected to an exit of the tumbler;

a heat exchanger connected to an exit of the fan through a first flow line, the first flow line being configured to carry a working fluid;

a compressor having (i) an entrance connected to the first flow line and (ii) an exit connected to an entrance of the heat exchanger; and a regeneration device having an entrance connected to an exit of the heat exchanger, wherein the regeneration device is connected to a circulation line configured to carry the working fluid, the circulation line connecting the heating device, the tumbler, the fan, and the heat exchanger, wherein the regeneration device comprises:

a gas-liquid separator that has a gas exit connected to the circulation line, a decompression device disposed at at least one of (i) a flow line that connects the exit of the heat exchanger to an entrance of the gas-liquid separator or (ii) a flow line that connects the gas exit of the gas-liquid separator to the circulation line, a first bypass line having two ends that are connected to respective ends of the decompression device, and a first bypass valve disposed at the first bypass line, and wherein the decompression device is one of a plurality of decompression devices including (i) a first decompression device disposed between the exit of the heat exchanger and the entrance of the gas-liquid separator and (ii) a second decompression device disposed in the circulation line at the gas exit of the gas-liquid separator.

2. The dryer according to claim 1, further comprising:

an accommodation duct that accommodates the heat exchanger therein, wherein the accommodation duct is connected to (i) the first flow line, (ii) a second flow line that is connected to an entrance of the heating device, and (ii) a third flow line that is connected to the entrance of the compressor.

3. The dryer according to claim 1, wherein the gas exit of the gas-liquid separator is connected to a flow line that is configured to carry the working fluid and that connects the heating device to the tumbler.

4. The dryer according to claim 1, wherein the gas exit of the gas-liquid separator is connected to a flow line that is configured to carry the working fluid and that connects the tumbler to the fan.

5. The dryer according to claim 1, wherein the gas exit of the gas-liquid separator is connected to the first flow line that is connected to the exit of the fan.

6. The dryer according to claim 1, wherein the gas exit of the gas-liquid separator is connected to a flow line that is configured to carry the working fluid and that is connected to an entrance of the heating device.

7. The dryer according to claim 1, wherein the gas-liquid separator further has a condensed water exit, and wherein the regeneration device further comprises a steam trap that is connected to the condensed water exit of the gas-liquid separator.

8. The dryer according to claim 7, wherein the regeneration device further comprises:

a second bypass line having two ends that are connected to respective ends of the steam trap; and a second bypass valve disposed at the second bypass line.

9. The dryer according to claim 1, wherein the regeneration device comprises:

a preheating device disposed at a flow line that is connected to the exit of the heat exchanger; and an outside air inflow line having (i) an entrance configured to receive air from an outside of the dryer and (ii) an exit connected to the circulation line, the outside air inflow line passing through the preheating device.

10. The dryer according to claim 9, wherein the regeneration device further comprises a control valve disposed adjacent to the entrance of the outside air inflow line.

11. The dryer according to claim 10, wherein the outside air inflow line is connected to at least one of (i) the first flow line, (ii) a second flow line that is configured to carry the working fluid and connected to an entrance of the heating device, (iii) a third flow line that is configured to carry the working fluid and connects the heating device to the tumbler, or (iv) a fourth flow line that is configured to carry the working fluid and connects the tumbler to the fan.

12. The dryer according to claim 1, wherein the circulation line comprises (i) the first flow line, (ii) a second flow line that is configured to carry the working fluid and connected to an entrance of the heating device, (iii) a third flow line that is configured to carry the working fluid and connects the heating device to the tumbler, and (iv) a fourth flow line that is configured to carry the working fluid and connects the tumbler to the fan.

13. The dryer according to claim 1, wherein the working fluid includes steam.

14. A method for operating the dryer according to claim 1, the method comprising:

operating the fan;

operating the compressor;

operating the heating device; and stopping operation of the heating device based on an elapse of a set time period after operating the heating device.

15. The method according to claim 14, wherein the gas-liquid separator further has a condensed water exit, the gas exit being connected to the circulation line, and wherein the regeneration device further comprises a steam trap connected to the condensed water exit of the gas-liquid separator.

16. The method according to claim 15, wherein the regeneration device further comprises:

a second bypass line that has two ends connected to respective ends of the steam trap; and a second bypass valve disposed at the second bypass line.

17. The method according to claim 14, wherein the regeneration device comprises:

a preheating device disposed at a flow line that is connected to the exit of the heat exchanger;

an outside air inflow line having (i) an entrance configured to receive air from an outside of the dryer and (ii) an exit connected to the circulation line, the outside air inflow line passing through the preheating device; and a control valve disposed adjacent to the entrance of the outside air inflow line.

* * * * *